United States Patent [19]

Kleinguenther

[11] 4,233,752

[45] Nov. 18, 1980

[54] APPARATUS AND PROCESS FOR TREATING WOOD AND FIBROUS MATERIALS

[76] Inventor: Robert A. Kleinguenther, Rte. 4, Box 433, Seguin, Tex. 78155

[21] Appl. No.: 27,760

[22] Filed: Apr. 6, 1979

Related U.S. Application Data

[63] Continuation-in-part of Ser. No. 787,881, Apr. 15, 1977, abandoned.

[51] Int. Cl.[3] ..... F26B 3/00; F26B 7/00; F26B 5/04

[52] U.S. Cl. ..... 34/9.5; 34/13.4; 34/13.8; 34/16.5

[58] Field of Search ..... 34/9, 9.5, 12, 13, 13.4, 34/13.8, 16.5

[56] References Cited

U.S. PATENT DOCUMENTS

| | | | |
|---|---|---|---|
| 1,328,505 | 1/1920 | Fish, Jr. | 34/9.5 |
| 3,064,363 | 11/1962 | Ikeuchi | 34/9.5 |
| 3,685,959 | 8/1972 | Dunn, Jr. et al. | 34/9.5 |
| 4,017,980 | 4/1977 | Kleinguenther | 34/16.5 |

*Primary Examiner*—John J. Camby
*Attorney, Agent, or Firm*—John C. Stahl

[57] ABSTRACT

Apparatus and process for treating wood and other fibrous materials within a hermetically sealed, heat insulated chamber comprising means for applying a predetermined mechanical pressure to said fibrous materials, means for controlling the conditions within said chamber whereby steam is generated in the center of said fibrous materials, and means for subsequently removing said steam; means are additionally provided for staining, finishing, fireproofing, laminating, forming, shaping, and increasing the density and tensile strength of said fibrous materials.

11 Claims, 16 Drawing Figures

Fig. 7
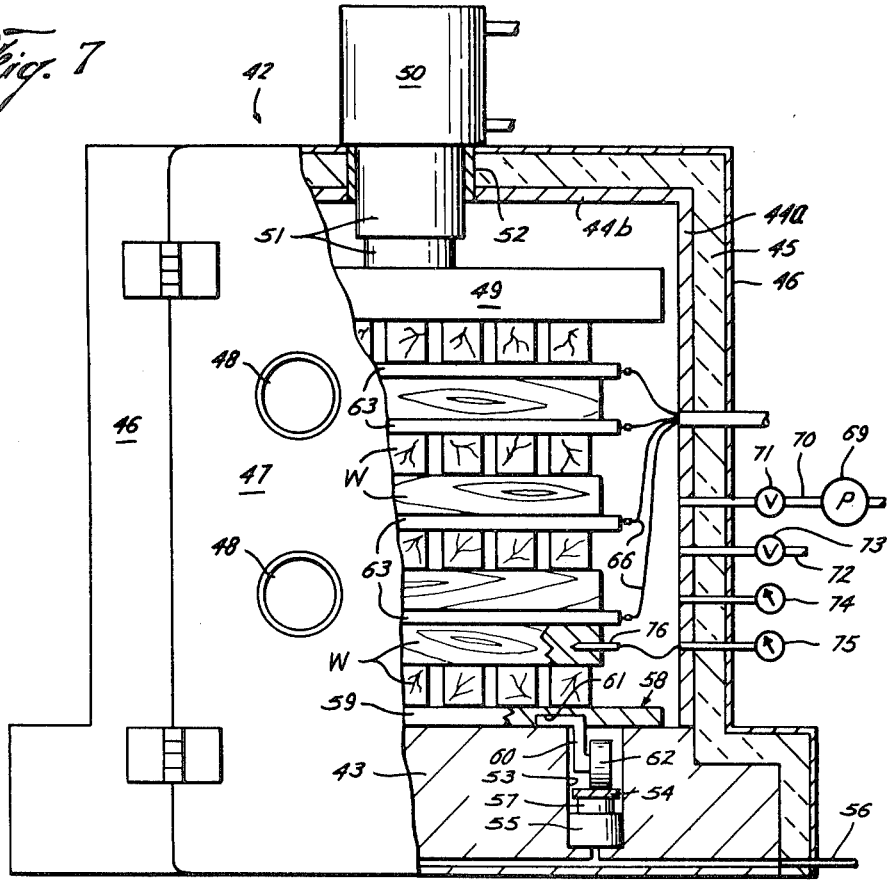
Fig. 9
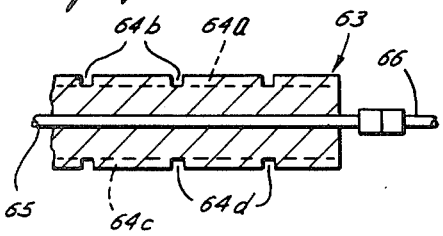
Fig. 8
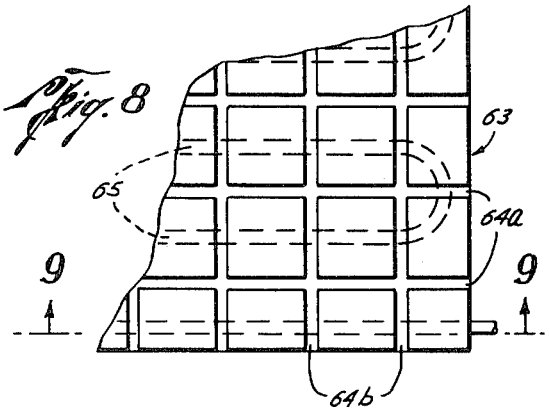
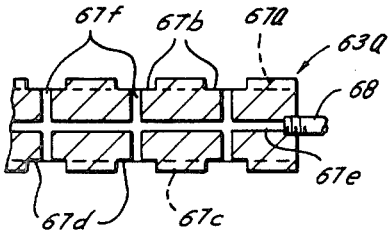
Fig. 10

APPARATUS AND PROCESS FOR TREATING WOOD AND FIBROUS MATERIALS

REFERENCE TO RELATED APPLICATION

This application is a continuation-in-part of applicant's copending application Ser. No. 787,881, filed on Apr. 15, 1977, now abandoned.

BACKGROUND OF THE INVENTION

Heretofore it has been the general practice to dry woods and other fibrous materials in a kiln or oven whereby the moisture in the material undergoing treatment is first converted into steam and thereafter said steam is removed. In those processes wherein the outer surfaces of said materials are dried first, any steam subsequently formed must pass through this dried outer zone with resultant cracking and splintering of the material. Additionally, in many woods, gums and resins are destroyed if the process is conducted at elevated temperatures thereby degrading the product or decreasing the market value thereof.

SUMMARY OF THE INVENTION

It is therefore the primary object of the invention to provide apparatus and a process for drying fibrous materials under controlled conditions, further including staining, finishing, fireproofing, laminating, forming, shaping and increasing the tensile strength thereof.

Another object is to provide apparatus and a process for drying fibrous materials including means to apply mechanical pressure to said materials and also permit a source of heat, steam, atmospheric pressure, dry air, vacuum and other fluids to be applied to or removed from said fibrous material.

A final object is to provide a process for drying woods wherein cracking and splintering is minimized and there is no degradation of the gums and resins in said wood.

BRIEF DESCRIPTION OF THE DRAWINGS

FIG. 7 is an end view, partly broken away and partly in section, of another embodiment of the subject invention.

FIG. 8 is a fragmentary, greatly enlarged, top plan view of another embodiment of plate utilized in the practice of the invention.

FIG. 9 is a vertical sectional view taken on the line 9—9 of FIG. 8, looking in the direction of the arrows.

FIG. 10 is a fragmentary, greatly enlarged, vertical sectional view of still another embodiment of plate of the subject invention.

DESCRIPTION OF PREFERRED EMBODIMENTS

Figure 1:
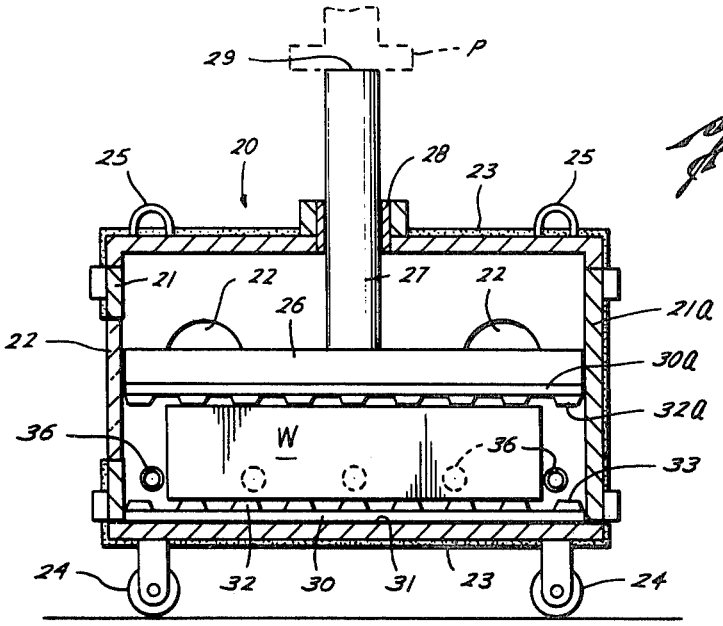
FIG. 1 is a vertical sectional view taken along the medial, longitudinal axis of a portable chamber of the subject invention.

Referring now to the drawings, wherein like reference characters designate like or corresponding parts throughout the several views, there is shown in FIGS. 1–6 of the drawings a portable, hermetically sealed, heat insulated chamber 20 of desired composition, shape and size, door 21 is secured in one end of said chamber in a fluid-tight seal and a second door 21*a* may in like manner be provided in the opposite end thereof to aid in loading and unloading. Viewing ports 22 are desirably provided in the side walls, ends or doors of said chamber to allow the user to observe the contents therein; insulation 23, such as is well known in the art, is normally applied exteriorly of the remainder of said chamber. Wheels 25 and/or eyes 25 are provided on said chamber whereby after loading in a manner hereinafter to be described said chamber may be rolled or lifted into position beneath a hydraulic press P or other pressure applying means at a remote location.

Horizontally extending and vertically adjustable plate 26 is carried within said chamber, preferably in a tight fit with respect to the opposing side walls and/or ends thereof; piston 27, secured downwardly to said plate, is journaled in bushing 28 mounted in the upper portion of said chamber; the upper end 29 of said piston extends at least partially above said chamber in all positions of plate 26. It is to be understood that the invention is not to be restricted solely to the use of a single plate 26 but also includes a plurality of smaller plates of desired plan view and size, each of which may be activated by a separate piston, whereby only selected plates and the corresponding portions of said chamber may be utilized at any time. Furthermore, the undersurface of plate 26 or the corresponding surfaces of said smaller plates may be essentially flat or may be of any predetermined configuration whereby wood products may also be shaped during the treating process. Still further, vertically and transversely extending closure members (not shown) may be provided interiorly of said chamber to form a plurality of smaller chambers which accommodate said smaller plates and preferably are to be used when only a limited number of pieces of wood are to be treated at one time.

Figure 2:
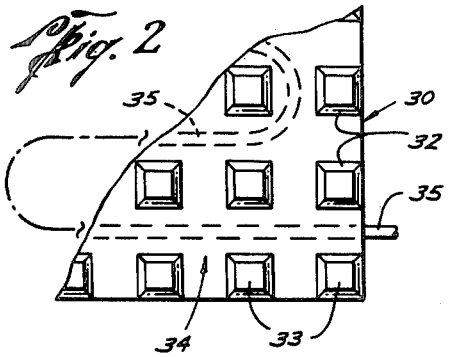
FIG. 2 is a fragmentary, greatly enlarged, top plan view of a plate utilized in the practice of the invention.

Plate 30 of metallic composition includes a flat surface 31 adapted to be supported upon the bottom of said chamber. As best seen in FIG. 2 of the drawings, the opposite surface of said plate includes a plurality of integrally formed, truncated pyramidal projections 32 each of which terminates upwardly in a flat 33 lying in the same horizontal plane. It is understood that projections 32 may be provided in any regular or irregular pattern on said plate and the space between adjacent projections, indicated generally by reference numeral 34, permits free circulation of fluids to a piece of wood or the like supported thereon. One or more heating elements 35 such as electric coils, high frequency thermal elements, heated water conduits or the like are conventionally applied to each plate in such manner as to provide a controlled, uniform distribution of heat.

Still referring to FIG. 1 of the drawings, a pre-cut piece of wood W of any desired shape and size is placed upon flats 33 of plate 30. For purposes of convenience only, a single piece of wood is illustrated; it is understood that any desired number of pieces, or rows, may be placed on said plate in like manner. An opposing plate 30*a*, similar in construction to plate 30, is inverted with downwardly depending projections 32*a* bearing against the upper surface of said wood. Plate 26 is then lowered and adjusted to bear firmly against the flat upper surface of plate 30*a*.

A plurality of apertures 36 in at least one side of said chamber slightly above the bottom thereof, or in the bottom, permit a source of hot air, steam, vacuum, or various chemical solutions to be introduced into or evacuated from the chamber thus formed.

Figure 3:
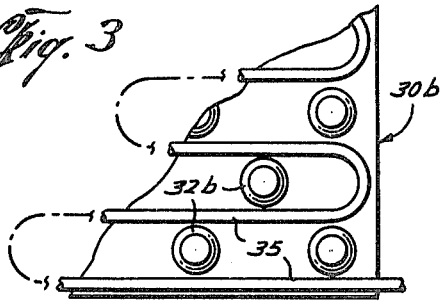
FIG. 3 is a fragmentary, greatly enlarged, top plan view of another embodiment of plate.

There is shown in FIG. 3 another embodiment of plate 30*b* wherein a plurality of integrally formed, truncated conical projections 32*b* are diagonally aligned. Heating element 35 is conventionally secured to the upper surface of plate 30*b* intermediate projections 32*b*.

Figure 5:
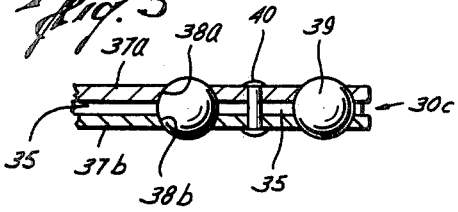
FIG. 5 is a vertical sectional view taken on the line 5—5 of FIG. 4, looking in the direction of the arrows.
Figure 4:
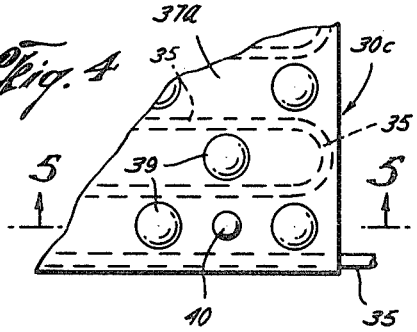
FIG. 4 is a fragmentary, greatly enlarged, top plan view of still another embodiment of plate.
Figure 6:
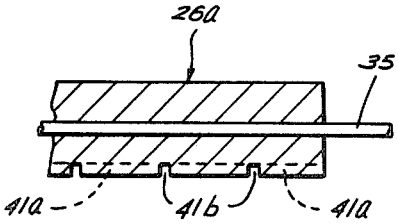
FIG. 6 is a greatly enlarged, vertical sectional view through another embodiment of vertically adjustable, pressure plate of the subject invention.

In the modification of FIGS. 4 and 5, plate 30*c* comprises sub-plates 37*a*–37*b* of similar construction, each of which includes a plurality of vertically aligned sockets 38*a*–38*b* adapted to receive a sphere 39 wherein each sphere at least partially extends outwardly of the surfaces of the opposing sub-plates. One or more heating elements 35 are carried between sub-plates 37*a*, 37*b* and said sub-plates secured together as by rivets 40 passing therethrough and expanded, or by other fastening means. A piece of wood placed upon plate 30*c* is supported by the upper portions of said spheres and fluids may freely circulate therebelow.

It is understood that the lower surface of plate 26*a*, substantially similar to plate 26 heretofore described, includes a plurality of parallel channels 41*a* which extend in one direction (see FIG. 6) and a plurality of interconnecting parallel channels 41*b* which are at approximate right angles relative thereto with heating element 35 carried in said plate; alternatively, said heating element may be carried on the upper surface thereof, in a conventional manner. In addition, the upper surface of the bottom of said chamber may include a plurality of interconnecting channels (not shown), in any regular or irregular pattern, with a heating element conventionally carried therein whereby a source of heat or fluids may be applied to one or more pieces of wood supported thereon.

There is shown in FIGS. 7–10 of the drawings another embodiment of the invention wherein hermetically sealed chamber 42 of desired shape and size comprises base 43, laterally spaced side walls 44*a*, and top wall 44*b* with insulation 45 such as is well known in the art applied exteriorly of such members; the insulated chamber thus formed is then inserted into or otherwise provided with an outer metallic casing 46 of conforming configuration. Door 47 is hingedly secured to selected portions of casing 46 in a fluid-tight seal. Viewing ports 48 are normally provided in at least door 47 and a television camera may be placed in a selected portion of said chamber whereby the materials undergoing treatment may be viewed.

Horizontally extending and vertically adjustable plate 49 of metallic composition is carried in said chamber. Hydraulic cylinder 50, secured to casing 46 or a supporting surface vertically thereabove, includes a downwardly depending piston 51 which is journaled in bushing 52 conventionally mounted in at least top wall 44*b* of said chamber; said piston is secured downwardly to plate 49.

As illustrated in FIG. 7, laterally spaced and longitudinally extending parallel channels 53 in base 43 accommodate horizontally disposed, rectangular plates 54 coextensive in length therewith. One or more hydraulic cylinders 55, carried in the lower portion of channels 53, are interconnected by means of hydraulic lines 56; piston 57 of each cylinder 55 connects to the lower surface of plates 54 whereby said plates are vertically adjustable.

A car 58 upon which pre-cut pieces of wood are to be loaded includes flat bed 59 of metallic composition with laterally spaced bracket means 60 secured in recesses 61 in the undersurface thereof; wheels 62, adapted to ride on plates 54 heretofore mentioned, are mounted on said brackets. When plates 54 are in elevated condition, car 58 may be rolled into the chamber; upon lowering said plates, the lower surface of bed 59 is uniformly supported on base 43.

As will hereinafter be more fully described, any desired number of rows of pre-cut wood W may be placed upon bed 59 with the pieces in each row in side-by-side relationship and slightly spaced while each row is placed at right angles relative to an adjacent row. Furthermore, one or more plates 63 of substantially similar construction and preferably smaller in length and width, respectively, than the corresponding dimensions of plate 49 and bed 59 are placed intermediate selected rows of wood. More specifically, each plate 63 is of metallic composition and the upper surface includes a plurality of parallel channels 64*a* (see FIGS. 8–9) with a plurality of interconnected parallel channels 64*b* approximately at right angles thereto. Channels 64*c*–64*d*, respectively, are in like manner provided in the lower surface of each plate. A heating coil 65 or high frequency thermal element is conventionally applied to each plate with conductor 66 or the like detachably connected thereto externally of said plate.

In the modification of FIG. 10, the upper surface of plate 63*a* includes a plurality of parallel channels 67*a* extending in one direction and interconnecting parallel channels 67*b* extending at approximate right angles thereto; the lower surface of said plate includes corresponding and vertically aligned channels 67*c*–67*d*; channels 67*a*–67*d* are substantially greater in width than channels 64*a*–64*d* heretofore described in connection with FIGS. 8–9 of the drawings. An essentially horizontally extending conduit 67*e* in plate 63*a* communicates with lateral conduits 67*f* which surface in selected channels 67*a*–67*d*. One end of flexible tube 68 or the like connects to the end of conduit 67*e* whereby a fluid may be applied to or removed from pieces of wood supported on or adjacent said plates 63*a*. A still further modified plate (not shown) includes a plurality of vertically extending bores of any desired diameter and arranged in any regular or irregular pattern, said bores passing completely through said plate and communicating with a larger conduit through which fluids may pass.

Referring again to FIG. 7 of the drawings, conductors 66 heretofore mentioned connect remotely to each of said plates 63, said conductors may be passed through side walls 44*a* or inserted into a socket (not shown) with a power supply electrically connected thereto. Vacuum pump 69, at any remote location, connects to said chamber by means of pipe 70 with valve 71 fitted therein. Pipe 72, connecting remotely to a source of hot air, steam, chemicals or the like, carries valve 73 and connects to said chamber. Desirably a vacuum gauge 74 and gauge 75 of a probe thermometer or the like are placed at any desired location and communicate with said chamber; probe 76 of said thermometer is adapted to be inserted into a bore in a selected piece of wood.

Figure 11:
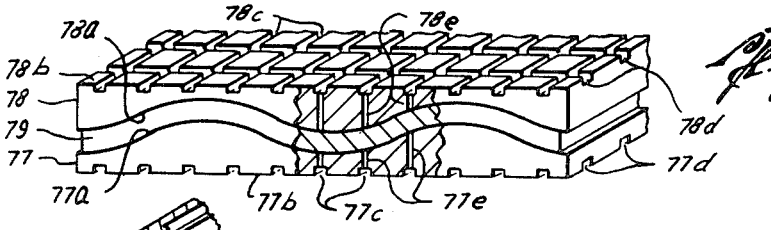
FIG. 11 is a fragmentary, perspective view, partly broken away and partly in section, of means utilized for shaping fibrous materials.

Referring now to FIG. 11 of the drawings, there is shown coacting metallic plates 77–78 of desired size which are used to form or shape fibrous material 79 therebetween in accordance with the principles of the subject invention. More specifically, inner surfaces 77*a*–78*a* of said plates may be of any regular or irregular configuration; base 77*b*–78*b* of each plate is flat and desirably includes a plurality of parallel channels 77*c*–78*c* extending in one direction and interconnecting parallel channels 77*d*–78*d* extending at approximate right angles thereto. A plurality of vertically extending bores 77*e*–78*e*, in any pattern or arrangement, terminate in surfaces 77*a*–78*a*, respectively, and communicate with at least one of said channels in the corresponding base.

Plates 77–78, with wood or other fibrous material 79 of desired dimensions therebetween, may be used in chambers 20, 42 or the like for the process of the subject invention. It is to be understood that although an elongated corrugated product is illustrated in FIG. 11, the invention is not to be restricted solely to such configured product but also covers any other shaped fibrous product in accordance with the principles of the invention.

Figure 12:
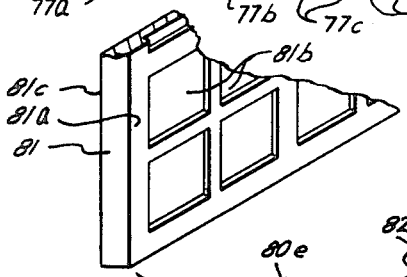
FIG. 12 is a fragmentary, perspective view showing means for forming a design in a laminated product.
Figure 13:
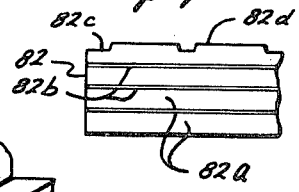
FIG. 13 is a fragmentary, enlarged end view of a laminated product with a design impressed in at least one surface of said product.
Figure 14:
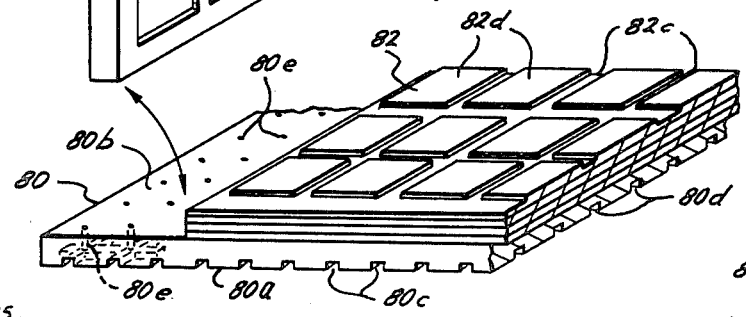
FIG. 14 is a fragmentary, enlarged end view of a laminated product of the subject invention.
Figure 14:
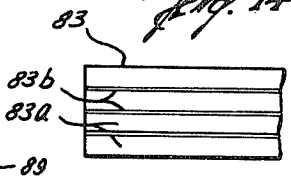

There is shown in FIGS. 12–14 of the drawings coacting plates 80–81 used to laminate sheets of wood or other fibrous material 82 therebetween, and more particularly, to laminate a plurality of sheets of fibrous material with a selected design or pattern in at least one outer surface thereof. Plate 80, of any desired size and of metallic composition, includes base 80*a* and a relatively flat upper surface 80*b*; a plurality of parallel channels 80*c* extending in a desired direction are provided in said base; a plurality of interconnecting parallel channels 80*d* extend at approximate right angles thereto. A plurality of bores 80*e*, in any pattern or arrangement, terminate upwardly in surface 80*b* and communicate downwardly with at least one of said channels 80*c*, 80*d*.

Plate 81 includes a relatively flat surface 81*a* with a plurality of depressions 81*b* of any desired configuration and depth therein. The opposing surface 81*c* of said plate is normally flat. It is understood that for laminating fibrous materials in excess of approximately one centimeter in thickness surface 81*c* may be provided with a plurality of channels (not shown) extending in any desired direction with vertical bores terminating, respectively, in surface 81*c* and at least one of said channels.

As best seen in FIG. 13 of the drawings, fibrous material 82 comprises a plurality of sheets 82*a* with adhesive 82*b* intermediate each sheet. Plate 81, with surface 81*a* extending downwardly, is placed in a desired position on said fibrous material. After completing the process of the subject invention, sheets 82*a* are laminated together with the selected design or pattern formed in the outer surface; specifically, flat surface 81*a* of plate 81 partially compresses the fibers in the outer sheet and forms corresponding recessed portions 82*c* while depressions 81*b* in plate 81 form raised areas 82*d* on said finished product.

The laminated product 83 of FIG. 14 comprises a plurality of sheets 83*a* of wood or other fibrous material with adhesive 83*b* intermediate said sheets. A product of uniform thickness and flat outer surfaces may be formed by using the flat surfaces 80*b* of two plates 80 or the like.

Figure 15:
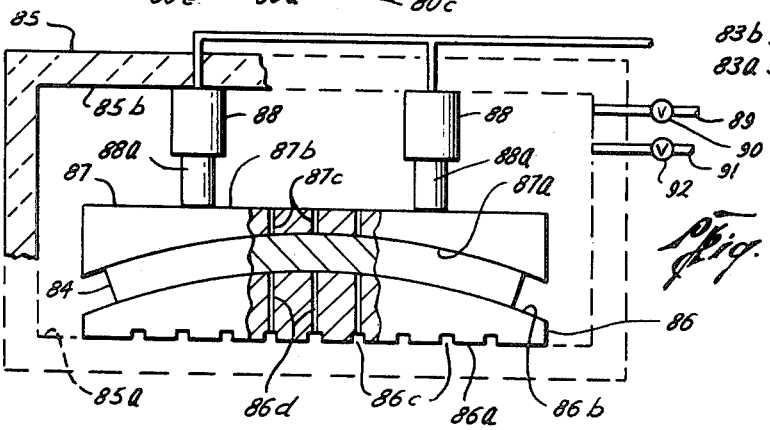
FIG. 15 is an end view, partly broken away and partly in section, of a chamber utilized in shaping fibrous materials.

There is shown in FIG. 15 of the drawings means to form or shape a heavy timber 84 or the like in accordance with the process of the subject invention. In general, chamber 85 of desired dimensions and adapted to be hermetically sealed and heat insulated includes base 85*a* with surface 85*b* spaced thereabove. Form 86, including flat base 86*a* and upper surface 86*b* of predetermined curvature, is positioned upon base 86*a* of said chamber. A plurality of parallel channels 86*c* extending in one direction are provided in base 86*a*; a plurality of vertical bores 86*d*, in any pattern or arrangement, terminate upwardly in upper surface 86*b* and communicate downwardly with a selected channel 86*c*.

Coacting movable form 87, including lower surface 87*a* of predetermined curvature and relatively flat upper surface 87*b*, is provided with a plurality of vertical bores 87*c*, in any pattern or arrangement, which terminate downwardly in surface 87*a* and upwardly in surface 87*b*, respectively.

Hydraulic cylinders 88, conventionally secured to selected portions of surface 85*b* of said chamber, include pistons 88*a* which connect downwardly to surface 87*b* of said movable form. A vacuum pump (not shown) connects to said chamber by means of pipe 89 with control valve 90 therein; a source of hot air, steam, chemicals or the like may be introduced into chamber 85 by means of pipe 91 with valve 92 carried therein.

Upon activating movable form 87, timber 84 is forced downwardly against form 86; a mechanical force in the range of 1–5000 kilograms/square centimeter applied to said timber, in combination with the remaining steps of the process, dries said timber to such predetermined curvature.

Figure 16:
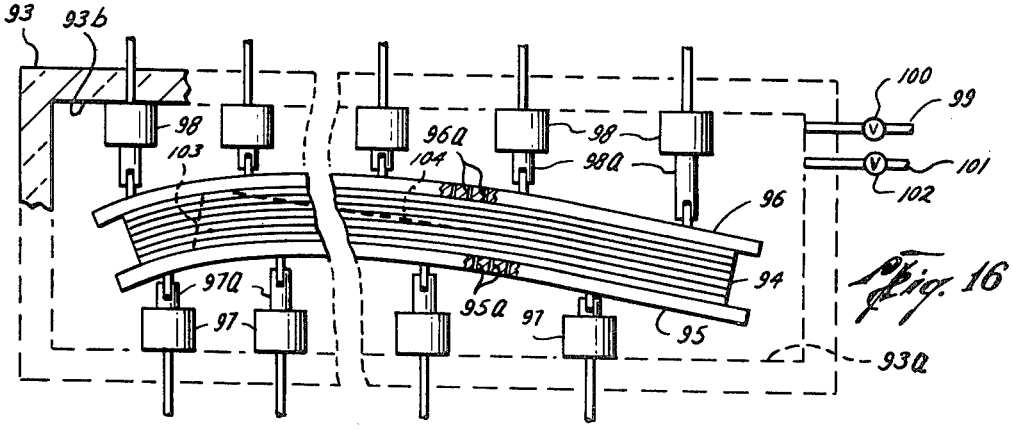
FIG. 16 is an end view, partly broken away and partly in section, of a chamber utilized in shaping and laminating fibrous materials.

There is shown in FIG. 16 of the drawings means to form laminated beams or the like wherein each selected portion may be formed or shaped to a predetermined curvature. Chamber 93, of desired size and adapted to be heat insulated and hermetically sealed, includes flat base 93*a* and surface 93*b* spaced thereabove. A laminated beam 94 is to be formed between lower and upper flexible metallic plates 95–96. In general, a plurality of hydraulic cylinders 97 are conventionally mounted in spaced relation on base 93*a*; piston 97*a* of each cylinder pivotally connects upwardly to a selected portion of lower plate 95. In like manner, hydraulic cylinders 98 are mounted on surface 93*b*, desirably intermediate cylinders 97 on said base, with pistons 98*a* pivotally connecting to selected portions of upper plate 96. A plurality of vertically extending bores 95*a*–96*a*, in any pattern or arrangement, pass completely through plates 95–96, respectively.

A vacuum pump (not shown) connects to chamber 93 by means of pipe 99 with valve 100 carried therein; a source of hot air, steam, chemicals or the like may be introduced into said chamber by means of pipe 101 with valve 102 fitted herein.

Prior to use, any desired number of sheets or boards of wood or other fibrous material, of any dimensions, are placed between plates 95–96 with an epoxy or phenol resin intermediate all abutting sides and ends of each such sheet or board, after which selected cylinders 97–98 are activated to apply a predetermined force in the range of 1–5000 kilograms/square centimeter to the corresponding portions of plates 95–96 and shape the fibrous materials therebetween, in accordance with the principles of the invention.

It is understood that beam 94 thus formed may be of uniform thickness or a beam 103 having a flat base 104 may be produced therefrom by cutting or trimming.

Selected portions of plates 77–78, 80–81, 86–87, and 95–96 may be provided with heating means similar to heating elements 35 heretofore described or a plurality of interconnected pipes or conduits (not shown) in any regular or irregular pattern, whereby a source of heat or fluids may be applied thereto or circulated therethrough. Still further, selected portions of chambers 20, 42, 85 and 93 may be provided with heating means such as electric coils, heated water conduits or high frequency thermal elements or the like whereby said chambers may be uniformly heated to any desired temperature, either for preheating said chambers or for primary or auxiliary use at any time during the process. Additionally, rotatable plates (not shown) may be provided whereby trapped particles of water or the like are removed by centrifugal force. Each of the plates heretofore described may also be vertically disposed or coacting and vertically disposed pressure plates (not shown) may be used in combination with such essentially horizontally extending plates to provide mechanical pressures to all four sides of a timber or the like.

The wood treating process of the subject invention will now be discussed in detail; it is understood that henceforth throughout the specification and claims the word "treating", as applied to woods or other porous and fibrous materials, is used in a generic sense and includes not only drying but also staining, finishing, fireproofing, laminating, forming, shaping and increasing the density or tensile strength thereof. For purposes of convenience only, the wood treating process of the subject invention will be described in connection with chamber 42 of FIG. 7; it is understood that similar steps are utilized in connection with chambers 20, 85 and 93.

To expedite said treating process, an initial pre-heat step of any desired duration may be utilized, either prior to or after loading chamber 42. More specifically, "contact heat", provided by heating means in plates 30–30*c* or plates 63–63*a*, may be applied to said wood. Either simultaneously therewith, or alternatively, "atmospheric heat", such as hot air, saturated hot air, steam or superheated steam,, may be applied to said wood, provided that no substantial air currents are created in the chamber which tend to dry out the external wood fibers and hinder the subsequent removal of moisture. During such pre-heat stage, if no mechanical pressure is applied to a selected piece of wood, the temperature within said wood must not exceed 60° Centigrade or warping and cracking will occur. If a pressure ranging from 1–5 kilograms/square centimeter is applied to said piece, the temperature within said piece must not exceed 80° Centigrade.

After hermetically sealing chamber 42, valves 71, 73 are closed. At this time, a vacuum in the order of 0.005–700 mm. Hg may be applied to said chamber for 3–120 minutes to remove excess moisture from said wood.

A predetermined mechanical pressure within the range of 1–150 kilograms/square centimeter is then applied to said pieces of wood W by means of hydraulic cylinder 50. Mechanical pressure in the range specified, in combination with the remaining steps of the process hereinafter to be described, prevents warping and minimizes the formation of cracks. Furthermore, after a predetermined pressure within the specified range is applied to said wood, plate 49 may then be secured in such position whereby although the wood may initially shrink and pull away from said plate any subsequent expansion of the wood is limited by said plate and a finished product of desired and constant thickness is formed. Finally, the application of a predetermined higher pressure within said range advantageously results in a substantial increase in the tensile strength of such piece. In general, if a selected piece of wood is not to be formed or shaped and no substantial increase in tensile strength is desired, a pressure of approximately 5 kilograms/square centimeter is normally applied to a piece of wood not exceeding 15 millimeters in thickness; a pressure of approximately 15 kilograms/square centimeter is required to form or shape pieces of wood ranging from 2–8 millimeters in thickness. When a pressure of 15 kilograms/square centimeter is applied to a flat piece of wood having an initial thickness of approximately 12 millimeters, for example, the tensile strength is increased 30–40 percent. Still further, pressures from 120–150 kilograms/square centimeter are required for heavy timbers, especially to upgrade the quality of the wood by increasing the tensile strength thereof.

When the wood or other fibrous material is of substantial thickness or the structure is of such a nature as to resist the flow of moisture to the surface thereof, it is desirable to first convert the moisture in said fibrous material into steam. It will be appreciated that if the outer surfaces of said material are permitted to dry first, said outer surfaces will shrink thereby entrapping moisture in the inner portions of such material and the steam subsequently formed must pass through said dry outer surfaces with resultant cracking, splintering and other physical damage to the material.

In each of the embodiments of the process of the subject invention, the wood or other material is dried from the center outwardly; specifically, steam which is formed in the center of said material is subsequently driven outwardly under controlled conditions. To expedite the formation of steam within the center of a selected piece of wood, a temperature in the range of 70°–200° Centigrade is applied to said wood in said chamber; more specifically, a desired temperature, in the range specified, is at least partially provided by "contact heat", heretofore defined. In addition, "atmospheric heat", heretofore defined, is admitted into chamber 42 by means of valve 73 either prior to the application of said "contact heat", simultaneously therewith, or thereafter. The source of "atmospheric heat" is controlled and preferably regulated to match the temperature of said "contact heat" whereby a uniform temperature is applied to all surfaces of said wood.

Either simultaneously with such heating step or shortly thereafter, and before steam is formed in said wood, the atmospheric pressure within the chamber is raised to 2–200 atmospheres; the "atmospheric pillow" thus formed, substantially greater in pressure than the steam pressure within said piece, not only prevents the entrapped steam from escaping but also causes the pressure of the entrapped steam to equalize in each such piece. Furthermore, said "atmospheric pillow" preserves the moisture in the outer surfaces of each piece whereby the moist, warm and expanded surface wood fibers provide a path through which the entrapped steam may pass.

Probe 76 or other instrumentation is utilized to indicate the temperature within the central portion of a selected piece of wood. In general, when thermometer 75 indicates a temperature in the range of 70°-200° Centigrade, dependent primarily upon the variety of wood, a source of heat, such as hot air, either dry or at least partially moisturized, or steam, at a temperature approximately equal to the temperature of the wood in said chamber, is applied to said chamber and the atmospheric pressure within said chamber simultaneously reduced to facilitate the removal of expanded steam from the center of each piece. Alternatively, a dehumidifier or the like may be connected to chamber 42 whereby the moisturized air or steam withdrawn from the wood is removed from said chamber. The mechanical pressure applied to said wood may be increased at this stage, within the specified range, to increase the tensile strength; additionally, the temperature applied to said wood may also be increased, within the range specified, to speed up the process provided that such increased temperature does not melt the resins, gums or "Farbkernstoff" or cause the same to erupt from and mar the surfaces of said wood.

The atmospheric pressure within said chamber is gradually reduced, while maintaining said chamber at elevated temperature, until room pressure is reached at which time valve 71 is opened and a vacuum in the order of 0.005-700 mm. Hg applied to said chamber. Alternatively, a centrifugal force may be applied to said fibrous material, during said vacuum step, to remove any remaining low pressure steam from said wood.

All sources of heat applied to said wood and/or chamber are then cut off and the chamber cooled, wile maintaining mechanical pressure on said wood; desirably water or a coolant such as is well known in the art is circulated through the walls of said chamber and/or plates thereof for a period of 2-60 minutes to aid in cooling said chamber and the materials therein. The vacuum is then released, the wood further cooled while still under mechanical pressure, after which all mechanical pressure applied to said wood is released and the wood removal from said chamber.

Test results indicate that green wood having a moisture content in excess of 80% can be reduced to less than 8% in periods ranging from 20-40 minutes in accordance with such teaching; furthermore, the moisture level can be reduced substantially below 8% if longer periods are employed.

It is understood that additional steps may also be included in such treating process whereby staining, finishing, preserving, fireproofing, laminating, forming or shaping, and increasing the tensile strength of fibrous materials may conveniently be accomplished. An alcohol, oil or water base stain may be applied to a piece of wood or other fibrous material either prior to or after loading chamber 42. The moisture in an untreated piece of wood aids the initial penetration of stain into said wood; after treating in the manner hereinafter described, such stain is evenly distributed throughout the entire piece. For example, a vacuum in the order of 0.005-700 mm. Hg is applied to said chamber to remove gases and air from said wood, and a selected stain, in either liquid or gaseous state, is introduced into said chamber. Alternatively, said wood may be immersed in a selected stain, either in chamber 42 or in an auxiliary chamber, and a vacuum in the order of 0.005-700 mm. Hg applied to said chamber until all bubbling within said stain ceases. The atmospheric pressure within said chamber is then increased to 2-200 atmospheres, said atmospheric pressure subsequently reduced to room pressure, and the wood treated in accordance with the remaining steps of the process.

Still further, said staining step may take place after said wood is at least partially dried and after the atmospheric pressure in said chamber is at approximately room pressure. At such time a selected stain is applied to said wood in chamber 42, either by flooding said chamber or injecting said stain under pressure into said chamber. The atmospheric pressure is then increased to 2-200 atmospheres after which any excess stain is removed from said chamber and a vacuum in the order of 0.005-700 mm. Hg applied to said chamber. The stained wood is subsequently dried and removed from said chamber.

In like manner, other chemical compositions in either a solid, liquid or gaseous state, may be applied to a selected fibrous material after a vacuum step. More particularly, a polyurethane, phenol, polyester, polyethylene, or epoxy, as well as copper chrome arsenate and ammonium chloride may be utilized. After all air and trapped gases are removed by a vacuum step in the order of 0.005-700 mm Hg., the selected chemical composition is introduced into said chamber, or said chamber may at least partially be flooded therewith and then drained after a prescribed period of time. The pressure within said chamber is then increased to 2-200 atmospheres whereby said composition is evenly dispersed throughout the porous material; heat, at the curing temperature of said chemical composition, is then applied to said chamber.

The staining step and one or more additional treating steps heretofore described may take place simultaneously. For example, a selected water base strain ranging from 1%-30% by weight, dependent upon the shade of color desired, with a phenol resin ranging from 10%-50% by weight, may be added to water. Chamber 42 may be flooded with said solution or said solution may be injected therein, followed by the remaining steps of the process heretofore described in detail.

Certain woods, although structurally sound, contain acids or salts which depreciate the market value thereof. The process of the subject invention permits washing of the wood fibers of such woods to remove said acids or salts. More specifically, said woods are placed in sealed chamber 42 after which a vacuum in the order of 0.005-700 mm. Hg is applied thereto. Water or a liquid adapted to neutralize said acids or salts is then introduced into said chamber and the atmospheric pressure increased to 2-200 atmospheres; the atmospheric pressure is then reduced to room pressure and the water or other liquid containing said acids or salts in solution is removed from said chamber. These steps are repeated for 3 minutes to 48 hours dependent upon the fiber structure and the chemical concentration, as well as the time between the several steps, until all acids or salts are removed or reduced to an acceptable level. If desired, an additional vacuum step in the order of 0.005-700 mm. Hg may then be applied to said chamber after which said vacuum is released. The wood may then be dried or otherwise treated in accordance with the principles of the subject invention.

Alternatively, after placing the wood to be treated in sealed chamber 42, the atmospheric pressure in said chamber is raised to 1.5–6 atmospheres; water or a liquid adapted to neutralize said acids or salts is then introduced into said chamber and the atmospheric pressure increased to 2–70 atmospheres and maintained at such pressure for 2 minutes to 24 hours, or longer. Thereafter the atmospheric pressure is reduced to room pressure and the water or other liquid containing said acids or salts in solution removed from the chamber; these steps may be repeated for 3 minutes to 48 hours until all acids or salts are reduced to an acceptable level. As heretofore mentioned, a vacuum step in the order of 0.005–700 mm. Hg may then be applied to said chamber after which the vacuum is released and the wood dried or otherwise treated in accordance with the principles of the invention.

In a further modified process of upgrading the quality of woods, after placing one or more pieces of wood in sealed chamber 42, water or a liquid adapted to neutralize said acids or salts is introduced into said chamber and a vacuum in the order of 0.005–700 mm. Hg is applied thereto and subsequently released. The atmospheric pressure in said chamber is then increased to 2–200 atmospheres, followed by the steps of reducing the atmospheric pressure to room pressure and removing the water or liquid containing said acids or salts in solution from said chamber. These steps may be repeated for 3 minutes to 48 hours until all acids or salts are reduced to an acceptable level. An additional vacuum step in the order of 0.005–700 mm. Hg may then be applied to the chamber after which the vacuum is released and the wood dried or otherwise treated in the manner heretofore described.

As is well known in the art, the melting point of certain gums and resins, especially those found in exotic woods, is in the order of 80°–90° Centigrade. In treating these woods a mechanical pressure in the range heretofore specified is first applied to said wood in said chamber, followed by a vacuum step ranging from 0.005–700 mm. Hg, dependent upon the species of wood, the thickness and moisture content thereof, for 3–150 minutes. A source of heat substantially below the melting point of said gums and resins is then applied to said wood by means of plates 30–30*c* or plates 63–63*a* whereby the moisture in said wood is converted into steam at reduced temperature with no degradation of the material.

During forming of shaping operations, after placing the wood or other fibrous material between the configured plates, said chamber may be flooded with a chemical composition such as ammonia or the like which advantageously softens the wood fibers and makes the piece more flexible and adaptable for forming and shaping. It is further understood that if the moisture content within a selected piece of wood exceeds 30%–35%, said piece cannot effectively be formed or shaped and the moisture content must first be reduced to such upper limit, desirably by means of a vacuum step in the order of 0.005–700 mm. Hg. The application of a mechanical force in the order of 1–5000 kilograms/square centimeter in combination with decreasing the moisture content in accordance with the principles of the invention not only forms said wood into the desired shape but also, when dried, said product maintains such desired shape. Staining and impregnation steps, heretofore described in detail, may simultaneously be conducted during such forming or shaping steps.

Laminated product 83 of FIG. 14 is formed using a plurality of moistened sheets 83*a* with adhesive 83*b*, applied as by spraying or brushing, intermediate said sheets; typical adhesives include epoxy and phenol resins and commercially available concentrated resins such as LEIMHARZ-LMB-1107. In one typical example of such laminated product 83, 125 grams of a phenol resin per square meter is conventionally applied to at least one surface of adjacent sheets. A mechanical pressure of 18 kilograms/square centimeter is applied to two plates similar to plate 80, with said unfinished product therebetween. An atmospheric pressure of 3 atmospheres and a temperature of 138° Centigrade is applied to chamber 42 for 50 minutes, thereby drying and simultaneously laminating sheets 83*a* together.

In preparing laminated beam 94 of FIG. 16, the moisture content of each sheet or board desirably should not exceed 30%–35%; below such limit the moistened wood fibers are flexible and readily formed to a predetermined curvature. After drying, in accordance with the principles of the invention, beam 94 maintains such predetermined curvature.

In the prior art methods of preparing laminated wood products, an adhesive is generally applied intermediate adjacent sheets of veneer or the like; said adhesive penetrates only the outer portions of adjacent sheets and the bond thus formed is only between such portions. In the improved processes of forming laminated wood products, panels and beams of the subject invention, the several sheets of veneer, boards or timbers are impregnated with a bonding composition whereby, after processing, the entire mass is structurally bonded together and the product is integral. For example, in the improved process for preparing a laminated wood product, selected sheets of wood veneer of desired thickness are impregnated (step 0) with a bonding composition adapted to cure under predetermined conditions of heat and pressure, such as phenolic resins, polyurethanes, polyesters and epoxy resins. The term "impregnated" as used throughout the specification and claims is defined as at least partially or completely saturating selected sheets of wood or other fibrous materials with a bonding composition as by soaking at atmospheric, reduced or elevated pressures, or by spraying, brushing or the like. Thereafter, two or more impregnated sheets are assembled (step 2) and placed between mechanical pressure means (step 3) in a closed chamber. Subsequently, the temperature within said chamber is raised to 70°–200° Centigrade (step 4), the atmospheric pressure increased to 2–200 atmospheres (step 5), 1–5000 kilograms/square centimeter applied to said mechanical pressure means (step 6), the temperature reduced, preferably to 40°–70° Centigrade (step 7), the atmospheric pressure reduced to room pressure (step 8), the mechanical pressure means released (step 9), and the laminated wood product removed from said chamber (step 10).

In modifications of such process, intermediate steps 8 and 9, a vacuum of 0.005–700 mm. Hg may be applied to said chamber and thereafter said vacuum released. If the humidity in the wood veneer exceeds 8%–12%, step 8 desirably precedes step 7; when such steps are reversed, after step 8, a vacuum of 0.005–700 mm. Hg may be applied to said chamber and said vacuum subsequently released. If desired, an ornamental design consisting of compressed and noncompressed areas, said compressed areas extending substantially into at least one surface of said wood product, may be applied thereto by the mechanical pressure means (step 6) in the manner heretofore described in detail in connection with FIGS. 11-13 of the drawings.

Referring more particularly to the impregnating step (1) heretofore mentioned, selected sheets of veneer may be soaked in a vat containing said bonding composition at atmospheric pressure for ½-5 days, dependent upon the thickness of the veneer, and the viscosity and temperature of said bonding composition. Alternatively, the wood veneer may be placed in a closed chamber which is then flooded with said bonding composition and an atmospheric pressure of 1-100 atmospheres applied thereto. Still further, after placing the veneer in a closed chamber, an atmospheric pressure in the range of 1-5 atmospheres may be applied thereto; said bonding composition is then conventionally injected into said chamber and the atmospheric pressure increased to 10-200 atmospheres. In another method of impregnation, wood veneer is placed in a closed chamber which is subsequently flooded with said bonding composition and a vacuum of 1-100 mm. Hg applied thereto; alternatively, after placing the wood veneer in a closed chamber a vacuum in the order of 1-100 atmospheres may first be applied to said chamber and thereafter the bonding composition introduced therein. If required, each of the aforementioned methods of impregnation may be repeated any number of times until the desired saturation of the wood veneer or fibrous material is achieved.

An alcohol, oil or water base stain may be applied to a piece of wood or other fibrous material either prior to the impregnating step 1, simultaneously therewith, or shortly thereater; after processing in the manner heretofore described such stain is evenly distributed throughout the entire piece.

In a still further modification of such process, especially in the manufacture of reinforced laminated wood products, panels or the like, at least one sheet of wire mesh or perforate material is interposed between at least two adjacent sheets of impregnated wood veneer during the assembly operations; during processing not only is such mesh or perforate material at least partially imbedded in the adjacent sheets of veneer but also the bonding composition flows between the apertures in said mesh or perforate material and after curing the entire mass is bonded together. It is understood that such reinforcing means may also be applied to a single sheet of impregnated wood veneer or the like to reinforce the same.

If desired, a sheet of material such as Teflon, plastic, aluminum foil or other sheet material providing sound, water or fire-retardant properties is placed on the upper surface of said assembled sheets of wood veneer whereby such sheet material is bonded to one outer surface of the finished product.

Each of the laminated wood products, wood panels or the like, with or without reinforcing means incorporated therein or applied thereto, may additionally be shaped into a desired configuration in accordance with the principles of the invention.

In each of the modified processes for producing laminated wood products heretofore described, the bonding composition in the several sheets of wood veneer is evenly distributed throughout and after processing in accordance with the principles of the invention said bonding composition cures or sets up in situ to form an integral product which is more dense, stronger, elastic, warp-resistant and highly water-resistant as well as stained and finished throughout.

In an improved process for preparing a laminated beam from a plurality of boards in accordance with the principles of the invention, each of said plurality of boards are impregnated (step 1), as such term has heretofore been defined, with a bonding composition such as phenolic resins, polyurethanes, polyesters or epoxy resins. The boards are then placed between mechanical pressure means (step 2) in a closed chamber, the temperature raised to 70°-200° Centigrade (step 3), the atmospheric pressure increased to 2-200 atmospheres (step 4), 1-5000 kilograms/square centimeter applied to said mechanical pressure means (step 5), the teperature in said chamber reduced, preferably to 40°-70° Centigrade (step 6), the atmospheric pressure reduced to room pressure (step 7), the mechanical pressure means released (step 8), and the laminated beam removed from said chamber (step 9).

To assure complete saturation of each of the boards, the method of impregnation utilized in step 1 may be repeated any desired number of times. Additional bonding composition may also be brushed or otherwise applied to the ends of each board, the innermost sides when a plurality of boards are used in a single course, and intermediate the several courses to assure a good bond therebetween. A staining step, heretofore described in detail, may be prior to the impregnating step 1, simultaneously therewith, or shortly thereafter. Additionally, reinforcing means may be applied intermediate at least two adjacent boards or courses thereof to strengthen said beam.

A vacuum in the order of 0.005-700 mm. Hg may be applied to the chamber after step 7 and said vacuum subsequently released. If the humidity within one or more boards exceeds 8%-12%, step 7 may precede step 6 and, if desired, a vacuum in the range heretofore described may be applied to the chamber after step 7. During step 5, the beam may be shaped into a desired configuration in the manner heretofore described in detail.

In another process of shaping a beam into a desired configuration, at least one selected piece of timber, wood or the like nor exceeding 30%-35% in moisture content is placed between mechanical pressure means in a closed chamber (step 1), the temperature raised to 70°-200° Centigrade (step 2), the atmospheric pressure raised to 2-200 atmospheres (step 3), 1-5000 kilograms/square centimeter applied to said mechanical pressure means (step 4), the temperature reduced, preferably to 40°-70° Centigrade (step 5), the atmospheric pressure reduced to room pressure (step 6), the mechanical pressure means released (step 7), and the shaped beam removed from said chamber (step 8).

Additionally, a vacuum of 0.005-700 mm. Hg may be applied to said chamber after step 5; if the humidity within said piece of wood exceeds 8%-12%, step 6 desirably precedes step 7; at such time, a vacuum in the range heretofore described may be applied to said chamber and said vacuum subsequently released.

The beam may additionally be impregnated with a bondition composition such as phenolic resins, polyurethanes, polyesters and epoxy resins whereby upon curing said bonding composition is uniformly distributed throughout said shaped beam. A staining step may be applied simultaneously with the impregnating step, prior thereto, or shortly thereafter. If desired, reinforcing means may be applied to at least one surface of said beam in the manner heretofore described.

It should be understood, of course, that the foregoing disclosure relates to only referred embodiments of the invention and that it is intended to cover all changes and modifications of the apparatus and processes herein chosen for the purposes of the disclosure which do not constitute departures from the spirit and scope of the invention.

What is claimed is:

1. A process for removing acids, salts and other chemical products from wood to upgrade the quality of said wood comprising the steps of (1) placing at least one piece of wood in a closed chamber, (2) applying a vacuum in the order of 0.005–700 mm. Hg to said chamber, (3) introducing a fluid into said chamber adapted to neutralize said chemical products in said wood, (4) increasing the atmospheric pressure in said chamber to 2–200 atmospheres, (5) reducing the atmospheric pressure in said chamber to room pressure, (6) removing the fluid from said chamber, and (7) removing the wood from the chamber.

2. The process of claim 1 wherein the fluid is water.

3. The process of claim 1 wherein steps (2)–(6) are repeated until all chemical products are reduced to an acceptable level.

4. The process of claim 3 further including the step, after reducing all chemical products in said wood to an acceptable level, of applying a vacuum in the order of 0.005–700 mm. Hg to said chamber and then releasing the vacuum.

5. The process of claim 1 further including the step of drying the wood in the chamber before removing said wood from said chamber.

6. A process for removing acids, salts and other chemical products from wood to upgrade the quality of said wood comprising the steps of (1) placing at least one piece of wood in a closed chamber, (2) increasing the atmospheric pressure in said chamber to 1.5–6 atmospheres, (3) introducing a fluid into said chamber adapted to neutralize said chemical products in said wood, (4) increasing the atmospheric pressure in said chamber to 2–70 atmospheres, (5) reducing the atmospheric pressure in said chamber to room pressure, (6) removing the fluid from said chamber, and (7) removing the wood from the chamber.

7. The process of claim 6 further including, intermediate steps (6)–(7), repeating steps (2)–(6) until all chemical products in said wood are reduced to an acceptable level.

8. The process of claim 6 further including, intermediate steps (6)–(7), applying a vacuum in the order of 0.005–700 mm. Hg to said chamber and then releasing said vacuum.

9. A process for removing acids, salts and other chemical products from wood to upgrade the quality of said wood comprising the steps of (1) placing at least one piece of wood in a closed chamber, (2) introducing a fluid into said chamber adapted to neutralize said chemical products in said wood, (3) applying a vacuum in the order of 0.005–700 mm. Hg to said chamber, (4) releasing the vacuum, (5) increasing the atmospheric pressure in said chamber to 2–200 atmospheres, (6) reducing the atmospheric pressure in said chamber to room pressure, (7) removing the fluid from said chamber, and (8) removing the wood from the chamber.

10. The process of claim 9 further including, intermediate steps (7)–(8), repeating steps (2)–(7) until all chemical products in said wood are reduced to an acceptable level.

11. The process of claim 10 further including, intermediate steps (7)–(8), applying a vacuum in the order of 0.005–700 mm. Hg to said chamber and then releasing said vacuum.

* * * * *